US006848677B2

(12) United States Patent
Cantley

(10) Patent No.: US 6,848,677 B2
(45) Date of Patent: Feb. 1, 2005

(54) PLASTIC FENCING SIMULATIVE OF WROUGHT IRON

(76) Inventor: Richard W. Cantley, 2065 Golfview Dr., Apt. 102, Troy, MI (US) 48084

( * ) Notice: Subject to any disclaimer, the term of this patent is extended or adjusted under 35 U.S.C. 154(b) by 0 days.

(21) Appl. No.: 10/358,956

(22) Filed: Feb. 5, 2003

(65) Prior Publication Data

US 2003/0155565 A1 Aug. 21, 2003

Related U.S. Application Data

(60) Provisional application No. 60/358,258, filed on Feb. 20, 2002.

(51) Int. Cl.[7] ..... E04H 17/16

(52) U.S. Cl. ..... 256/24; 256/19; 256/25

(58) Field of Search ..... 256/11, 19, 21, 256/22, 24, 25, 73; 52/102, 720.2

(56) References Cited

U.S. PATENT DOCUMENTS

| | | | | | |
|---|---|---|---|---|---|
| 13,712 | A | * | 10/1855 | Lachman | 278/113 |
| 140,897 | A | * | 7/1873 | Devoe | 256/21 |
| 2,516,807 | A | * | 7/1950 | Schulte | 256/24 |
| 3,902,703 | A | * | 9/1975 | Bouye | 256/24 |
| 3,933,311 | A | | 1/1976 | Lemelson | 239/276 |
| 4,070,007 | A | | 1/1978 | Minor | 256/19 |
| 4,154,431 | A | * | 5/1979 | Burnbaum | 256/19 |
| 4,477,058 | A | | 10/1984 | Lowery | 256/19 |
| 4,722,514 | A | | 2/1988 | Pettit | 256/50 |
| 5,215,290 | A | | 6/1993 | Khalessi | 256/19 |
| 5,255,897 | A | | 10/1993 | Pepper | 256/24 |
| 5,613,664 | A | | 3/1997 | Svalbe | 256/19 |
| 5,657,967 | A | | 8/1997 | Patrick | 256/19 |
| 5,702,090 | A | | 12/1997 | Edgman | 256/19 |
| 5,938,184 | A | | 8/1999 | DeSouza | 256/19 |
| 6,131,885 | A | | 10/2000 | Berg et al. | 256/19 |
| 6,173,944 | B1 | | 1/2001 | McCarthy | 256/19 |
| 6,182,948 | B1 | * | 2/2001 | Brandeis | 256/65.13 |
| 2002/0000545 | A1 | | 1/2002 | Pettit | 256/19 |
| 2002/0011594 | A1 | | 1/2002 | DeSouza | 256/19 |

FOREIGN PATENT DOCUMENTS

| | | | |
|---|---|---|---|
| GB | 2 123 051 A | 1/1984 | E04H/17/14 |

* cited by examiner

*Primary Examiner*—Daniel P. Stodola
*Assistant Examiner*—Michael P. Ferguson
(74) *Attorney, Agent, or Firm*—Gifford, Krass, Groh, Sprinkle, Anderson & Citkowski, PC

(57) ABSTRACT

An injection molded plastic fence panel that includes an upper horizontal rail and a lower horizontal rail. The panel also includes multiple spaced-apart vertical members extending between and interconnecting the upper and lower horizontal rails. The upper and lower horizontal rails each have a concave front surface and a concave rear surface with a pair of edges interconnecting the front and rear surfaces. The front and rear surfaces each have central regions intermediate the edges, with the central regions being separated by a distance less than the front-to-back depth of the edges.

11 Claims, 8 Drawing Sheets

Fig - 7
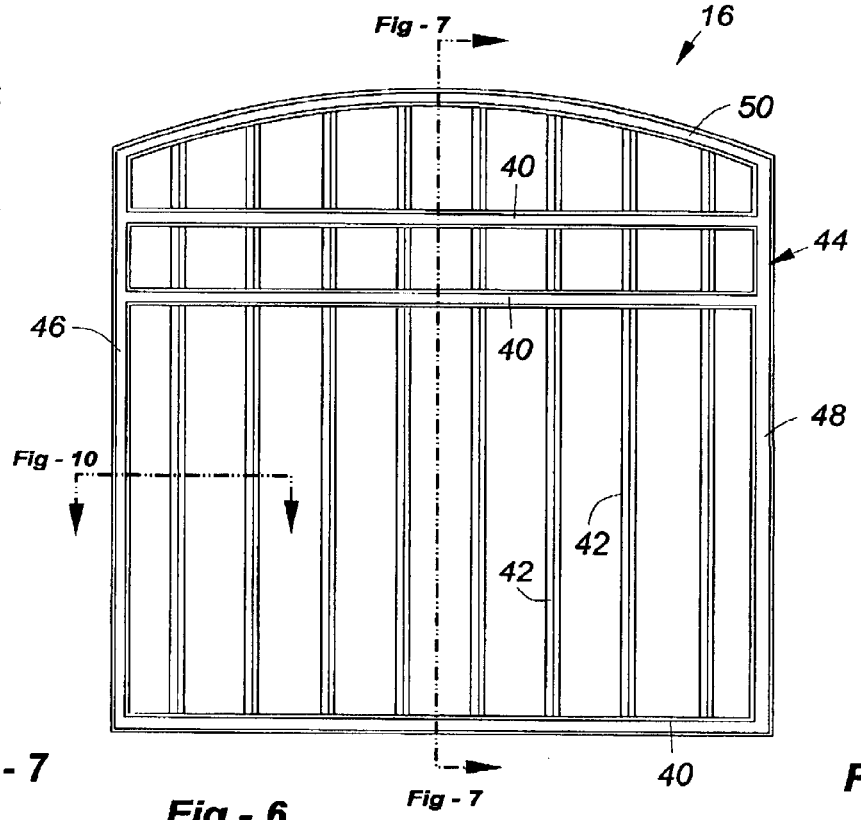
Fig - 6
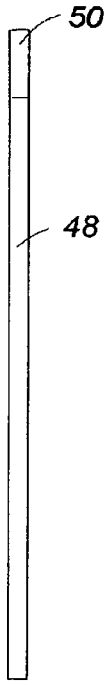
Fig - 8
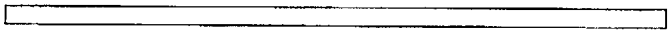
Fig - 9
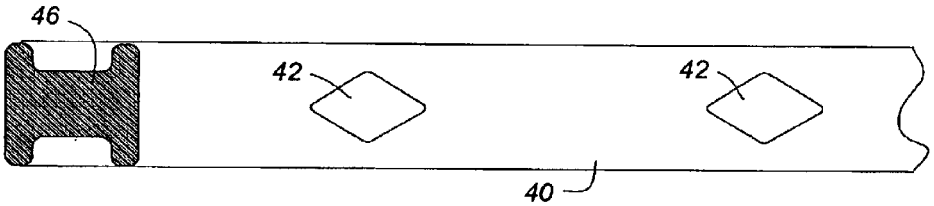
Fig - 10

PLASTIC FENCING SIMULATIVE OF WROUGHT IRON

REFERENCE TO RELATED APPLICATIONS

This application claims priority to U.S. provisional patent application Ser. No. 60/358,258, filed Feb. 20, 2002, the entire contents of which are incorporated herein by reference.

FIELD OF THE INVENTION

The present invention generally relates to injection molded parts and, more specifically, to plastic injection molded fence panels and components.

BACKGROUND

Traditional fencing is typically constructed of wood or metal. Each achieves appearances that property owners find pleasing and desirable, in addition to their basic function of regulating or restricting access. However, wood and metal fencing have drawbacks related to their cost and maintenance. These traditional materials are typically high in cost and labor intensive to construct and install. Weathering generally degrades their finish, necessitating periodic painting or staining.

Wrought iron fencing is a type of fencing that is strong, durable, and provides an easily recognizable and desirable appearance. However, wrought iron fencing tends to be very expensive and heavy to install. Many property owners would appreciate an alternative to wrought iron fencing that achieves a similar appearance without the cost, weight, and maintenance drawbacks.

SUMMARY OF THE INVENTION

The present invention provides an injection molded plastic fence panel including an upper horizontal rail and a lower horizontal rail. A plurality of spaced-apart vertical members extend between and interconnect the upper and lower horizontal rails. The upper and lower horizontal rails each have a concave front surface and a concave rear surface with a pair of edges interconnecting the front and rear surfaces. The front and rear surfaces each have central regions intermediate the edges. The central regions are separated by a distance less than the front-to-back depth of the edges.

BRIEF DESCRIPTION OF THE DRAWINGS

FIG. 6 is a front elevational view of a fence gate according to the present invention;

FIG. 7 is a cross-sectional view of the gate of FIG. 7, taken along lines 7—7;

FIG. 8 is a side view of the gate of FIG. 6;

FIG. 9 is a bottom view of the gate of FIG. 6;

FIG. 10 is a cross-sectional view of a portion of the gate of FIG. 6, taken along the lines 10—10;

DETAILED DESCRIPTION OF THE PREFERRED EMBODIMENTS

Figure 1:
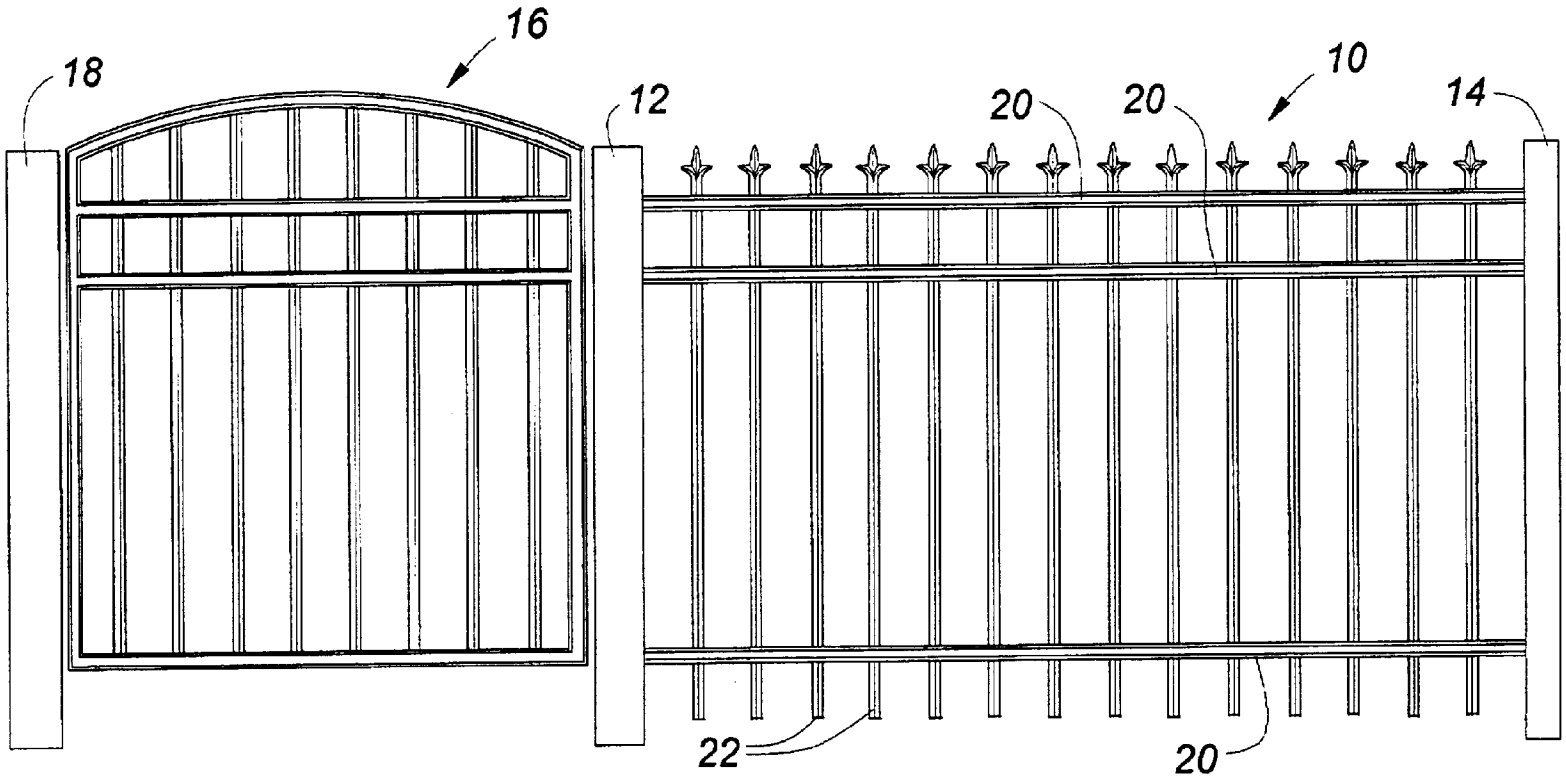
FIG. 1 is a front elevational view of a fence constructed with an injection molded plastic gate and an injection molded plastic fence panel according to the present invention.
Figure 2:
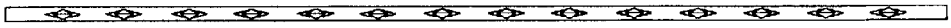
FIG. 2 is a top plan view of a fence panel according to the present invention.

A portion of a fence constructed with plastic injection molded components according to the present invention is illustrated in FIG. 1. The fence includes a fence panel or section 10 supported between a pair of posts 12 and 14. The fence panel 10 may be interconnected with the post 12 and 14 in a variety of ways, such as using brackets or hangers. The fence post may take a variety of forms, but are preferably of two types. The fence post 12 is a large embodiment of a fence post, and includes a 4×4 post that is set into the ground, with a plastic cover around the post. This creates a very rigid post. The post 14 is a smaller embodiment of a post, and is preferably plastic, without a wood core. The larger version of fence post 12 is preferably used at corners, at each side of a gate, and as needed along long runs of fencing to provide structural integrity. The smaller versions of fence post 14 may be used intermediate fence panels 10 where less structure is required. FIG. 1 also illustrates a gate 16 that forms part of the present invention. The gate is positioned between post 12 and the post 18, both of which are larger, more structural, posts. A variety of latches and hinges may be used for supporting the gate to one of the posts and latching it to the other.

The fence components 10–18 are of a particular style designed to simulate a wrought iron fence. However, various aspects of the present invention may be used with fence of other styles and to simulate other designs.

A single fence panel 10 is illustrated in more detail in FIGS. 2–5. As will be clear to those of skill in the art, multiple panels 10 may be arranged end-to-end, preferably with fence posts interposed, so as to form a fence, which may extend in a single direction or include corners and enclose an area.

As with known styles of wrought iron fencing, the fence panel 10 includes a plurality of horizontal rails 20 that extend between the fence posts 12 and 14. As shown, the horizontal rails 20 are generally parallel to each other, with two rails provided close to one another near the top of the fence panel 10, and a single rail 20 provided near the bottom of the fence panel. As will be clear to those of skill in the art, other designs may include different numbers and arrangements of horizontal rails 20. Preferably, one end of each of the horizontal rails 20 abuts the post 12, and the other end of the rails 20 abut the post 14. Preferably, at least two of the horizontal rails 20 are connected to each of the posts 12 and 14 using a bracket or hanger. The rails 20 may be terminated in other ways, or may be longer or shorter than illustrated.

As also shown, the fence panel 10 includes a plurality of spaced apart vertical members 22. Each of the vertical members 22 extends between and interconnects with the horizontal rails 20. In a preferred embodiment, the vertical members 22 and the horizontal rails 20 may be said to lie in the same plane, rather than above or below one another. That is, each of the vertical members 22 and horizontal rails 20 has a centerline or central axis, with each of the axes lying generally in the same plane. Alternatively, some of the members 22 or rails 20 may be offset from the common plane to achieve certain structural or design goals.

Figure 5:
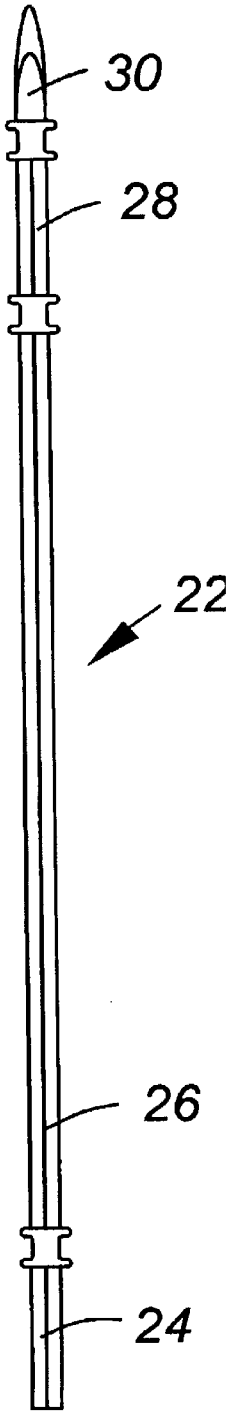
FIG. 5 is a cross-sectional view of the fence panel of FIG. 3, taken along lines 5—5.

The vertical members 22 preferably have a diamond-shaped cross-section. The cross-section and design of these vertical members 22 is consistent from their upper end to their lower end, as shown. However, they appear to merge into or pass through the horizontal rails 20 such that the vertical members 22 appear continuous, despite actually being discontinuous, as best shown in FIG. 5. Each vertical member may be said to have a bottom portion 24 that extends from the underside of the lowest horizontal rail 20 downwardly to the bottom end to the vertical member 22. Each vertical member 22 further has a middle portion 26 that extends from the upper side of the bottommost horizontal rail to the underside of the lower of the two upper horizontal rails. An upper portion 28 extends between the two upper horizontal rails, and a topmost portion 30 extends from the upper side of the uppermost horizontal rail to the upper end of the vertical member 22. Each of these portions 24–30 preferably have the same cross-section and central axes that are aligned. One design of injection-molded fencing may be provided with three horizontal rails 20 in the arrangement shown, along with a plurality of parallel vertical members 22 arranged in intervals along the horizontal rails 20. This provides a simple design simulative of wrought iron fencing.

Figure 3:
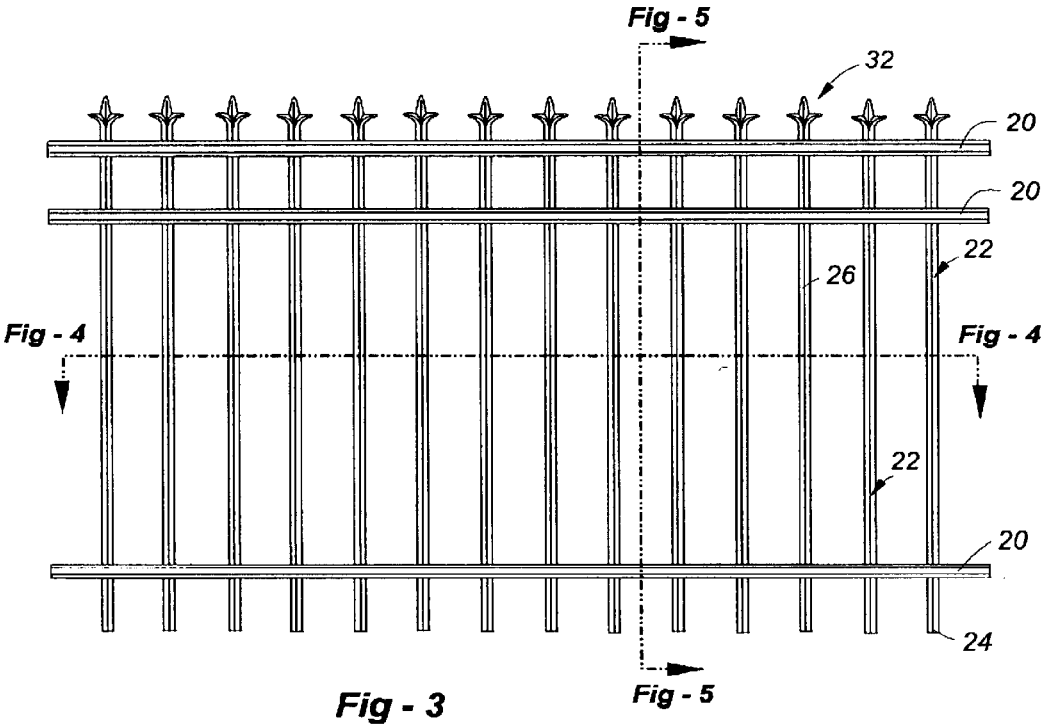
FIG. 3 is a front elevational view of a fence panel according to the present invention.
Figure 4:
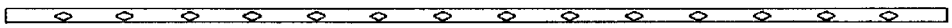
FIG. 4 is a bottom view of the fence panel of FIGS. 2 and 3.

As best shown in FIGS. 3 and 5, the uppermost end 30 of each of the vertical members 22 preferably terminate in a decorative finial, as is traditional with wrought iron fencing. As shown, each finial 32 has an upwardly extending point and a pair of sideways extending points. In the present invention, the points are preferably rounded to eliminate sharp points. As will be clear to those of skill in the art, different designs of finials may be used, or the finials may be eliminated, with each of the vertical members terminating either at the uppermost rail 20, or with a blunt end having the same cross-section as the remainder of the vertical member 22.

Referring now to FIGS. 6–10, the gate 16 will be described in more detail. The gate is constructed in a similar manner to the fence panel, and may be considered a fence panel for purposes of the present invention. It includes a plurality of straight horizontal rails 40 with a plurality of vertical member 42 extending between and interconnecting the horizontal rails 40. Additionally, the gate 16 preferably has a perimeter rail 44, which defines the perimeter of the gate 16. The perimeter rail includes the bottommost horizontal rail 40, a pair of vertical rails 46 and 48, and an arched top rail 50. The vertical members 42 preferably extend from the bottommost horizontal rail to the curved upper rail 50, and preferably do not extend above or below these rails. As with the fence panel 10, the vertical members 42 preferably have a diamond-shaped cross-section, as best shown in FIG. 10.

Figure 12:
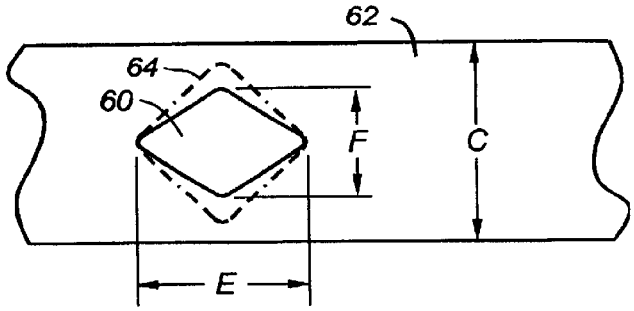
FIG. 12 is a detailed view of a cross-section of a vertical member.

FIG. 12 illustrates a cross-section of a single vertical member 60 where it abuts a horizontal rail 62. This vertical member 60 and horizontal rail 62 may be considered representative or a preferred embodiment of any of the vertical members and rails previously discussed. As shown, vertical member 60 preferably is thinner front-to-back than is the horizontal rail 62. Also, the vertical members are thinner front-to-back than side-to-side. Alternatively, the vertical members may have the same thickness front-to-rear as side-to-side, as shown by dotted lines at 64. However, the reduced depth cross-section is preferred. This shape substantially reduces the total amount of plastic used to mold a panel, while still providing a convincing three-dimensional appearance. Additionally, the thinner front-to-back depth of the vertical members allows the panels to be stacked more densely.

Figure 11:
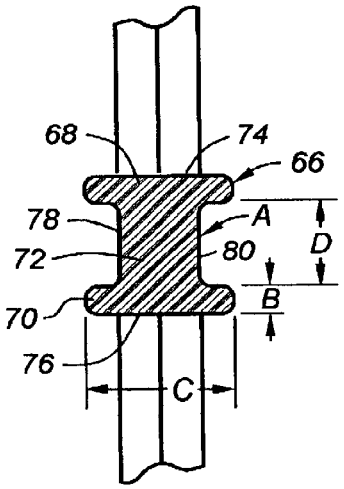
FIG. 11 is a detailed view of one horizontal rail that forms a portion of a fence panel according to the present invention.

Referring now to FIG. 11, the horizontal rails 66 preferably have an I-beam cross-sectional shape. This provides numerous advantages in the present invention. First, the I-beam cross-sectional shape provides a wide appearance while using less material than a solid cross-section with a square shape. Secondly, the I-beam shape has significant molding advantages. As shown, the I-beam cross-section has an upper leg 68 and a lower leg 70 interconnected by a central web 72. This provides thinner cross-sections in various areas, thereby facilitating cooling and accurate molding. In addition, the I-beam cross-section is strong and stiff. Example dimensions for the I-beam cross-section are as follows. The front-to-back depth of the central web 44 is indicated at A, and in some embodiments is approximately 0.625 inches. The height of the upper leg 40 or lower leg 42 is indicated at B, and in some embodiments is approximately 0.250 inches. The total width of the upper leg 40 or lower leg 42 is indicated by C, and may be approximately 1.125 inches. The height of the central web 44 is indicated at D and may be 1.00 inch, thereby giving a total height of the I-beam cross-section of approximately 1.5 inches.

As also shown in FIG. 11, the I-beam horizontal rail 66 preferably has a rounded profile. The horizontal rail 66 may be said to have an upper surface 74 defining the upper side of the upper leg 68 and a lower surface 76 defining the lower side of the lower leg 70. The central web 72 has a pair of opposed side surfaces 78 and 80. The side surfaces 78 and 80 radius into the undersides of the upper leg 68 and into the upper side of the lower leg 70. Likewise, the upper surface 74 and lower surface 76 radius around the outer edges of the I-beam cross-section. This smooth radiusing or rounding of the I-beam softens its appearance and also assists in the flow of plastic during the injection molding process.

Referring again to FIG. 12, sample dimensions for the vertical member 60 will be described. As previously described, the front-to-back depth of the horizontal rail 62, as shown at C, is approximately 1.125 inches. The diamond-shaped cross-section preferably has a front-to-back depth of approximately 0.625 inches, which is the same as the front-to-back depth, as shown at F, of the central web of the I-beam shaped horizontal rails. The diamond-shaped cross-section preferably has a side-to-side width, as shown at E, of approximately 0.834 inches. This is a ratio of depth-to-width of approximately 0.75. It is preferred that the depth-to-width ratio of the diamond-shaped members be less than 1.0, with it being more preferred that the ratio is below 0.9 or 0.8. The 0.75 ratio of the illustrated preferred embodiment, it found to give a pleasingly three-dimensional appearance, while minimizing the use of materials and facilitating stacking. Ratios below 0.75 are also possible. As with the decorative finials and the I-beam cross-section, the diamond-shaped cross-section preferably is slightly rounded at each of the corners.

Figure 13:
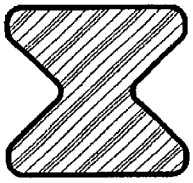
FIG. 13 is a detailed view of an alternative cross-section for a horizontal or a vertical member of a plastic injection molded fence panel according to the present invention.
Figure 14:
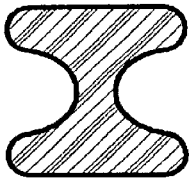
FIG. 14 is a detailed view of another alternative cross-section.
Figure 15:
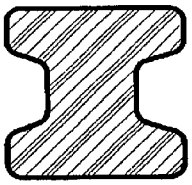
FIG. 15 is a detailed view of a third alternative cross-section.
Figure 16:
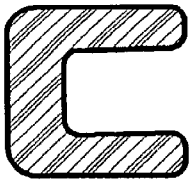
FIG. 16 is a detailed view of a fourth alternative cross-section.
Figure 17:
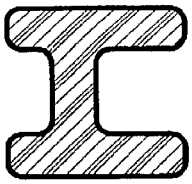
FIG. 17 is a detailed view of a fifth alternative cross-section.

Referring now to FIGS. 13–17, alternative cross-sectional shapes for the horizontal rails will be described. Preferably, the horizontal rails have a cross-section such that the front surface and rear surface are concave. This provides a central portion of each of the front and rear faces that is closer together than are the edges. FIGS. 13 and 14 illustrate two shapes which are referred to herein as bowtie-shaped cross-sections. FIG. 13 is a bowtie shape with the front and rear faces each being formed by a pair of flat surfaces that are joined at an angle. As with other aspects of the present invention, the transitions between surfaces are preferably rounded. FIG. 14 provides a rounded bowtie shape wherein the front and rear faces are both curved. FIG. 15 provides an alternative I-beam cross-section, which has a shape more like concrete I-beams. That is, rather than the upper and lower legs of the I-beam joining the webs at an approximately 90 degree angle, the transition between the central web and the upper and lower legs is at an approximately 45 degree angle. Other angles may be used as well for the transitions. FIG. 16 illustrates a C-shape cross-section which may be used for one of the horizontal rails. FIG. 17 illustrates another I-beam shaped cross-section, wherein the shapes of the front and rear faces are non-symmetrical. The central web is offset towards one side of the I-beam shape. A common trait to most of the cross-sectional shapes is that the front and rear face are preferably both concave. This creates a thinner cross-section in the horizontal rail, which aids in molding. As will be clear to those of skill in the art, other shapes are possible, including non-symmetrical versions of FIGS. 11 and 13–15. Also, a single face may be made concave, using any of the shapes illustrated, while the other face is flat or convex.

Referring again to FIGS. 6 and 10, it is shown that the vertical side rails 46 and 48 of the gate 16 also have an I-beam cross-section. These rails may be formed with any of the cross-sections discussed for the horizontal rails. Also, the present invention is not limited to the use of the discussed cross-sections for horizontal members. Instead, these cross-sections may be used for vertical or angled members in an injection-molded fence panel, as well as in other applications.

Figure 18:
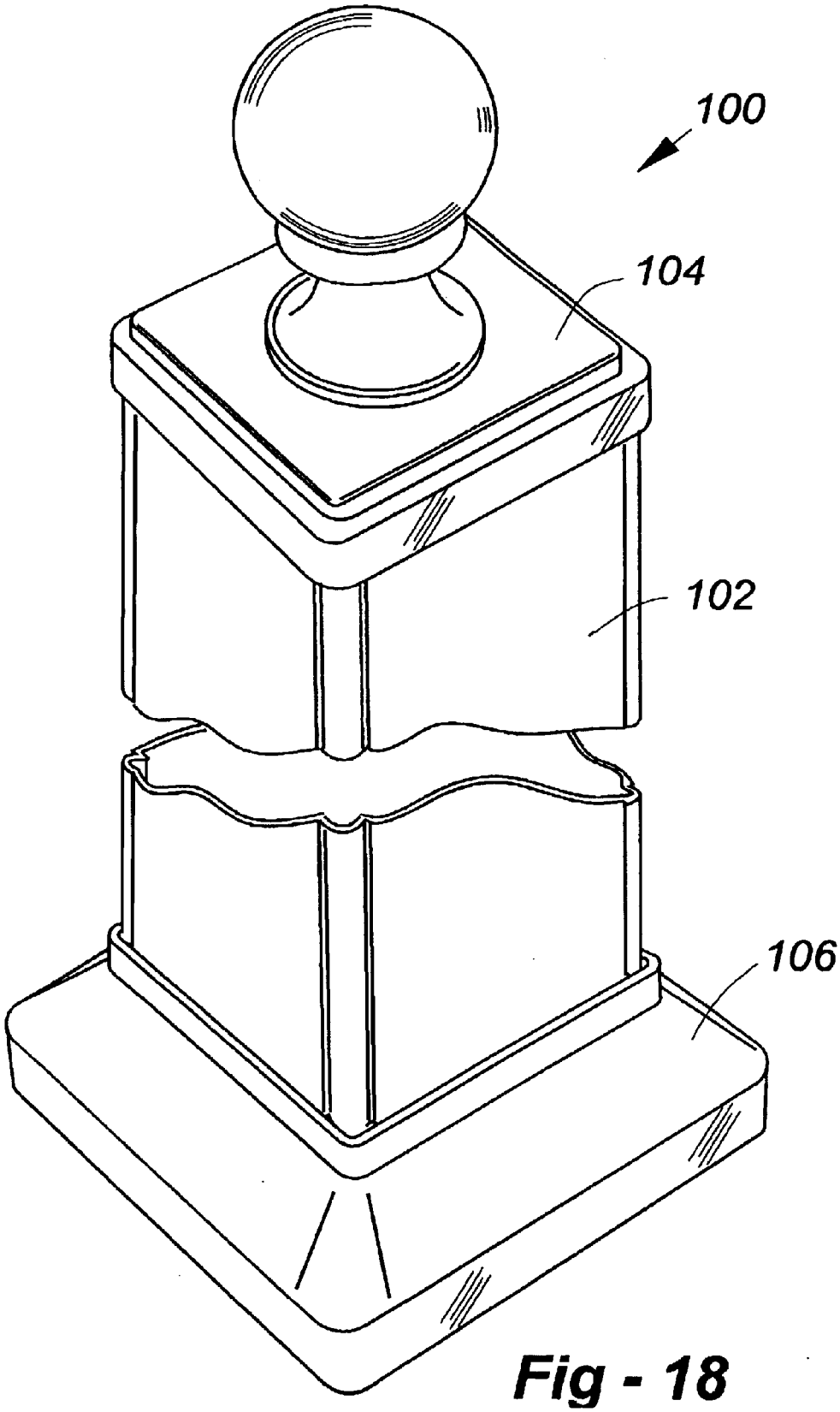
FIG. 18 is a perspective view of a fence post cover for use with the present invention.
Figure 19:
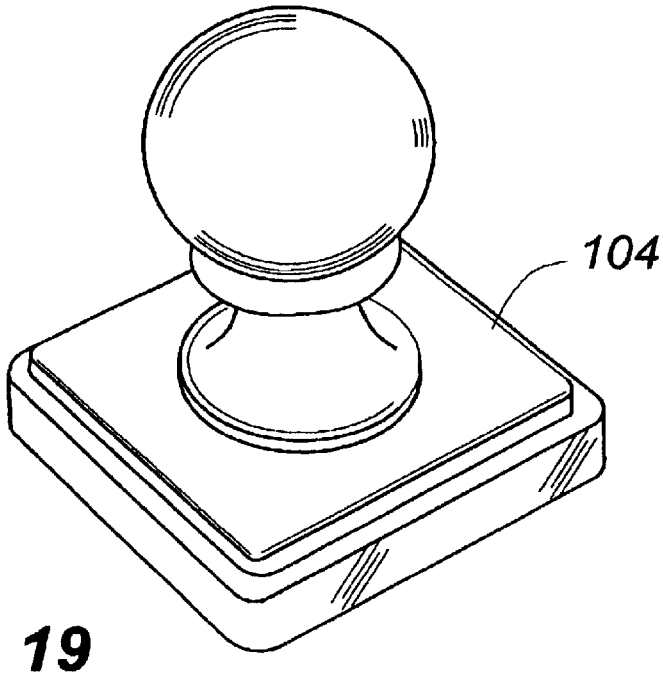
FIG. 19 is a perspective view of a top cap for a fence post for use with the present invention.
Figure 20:
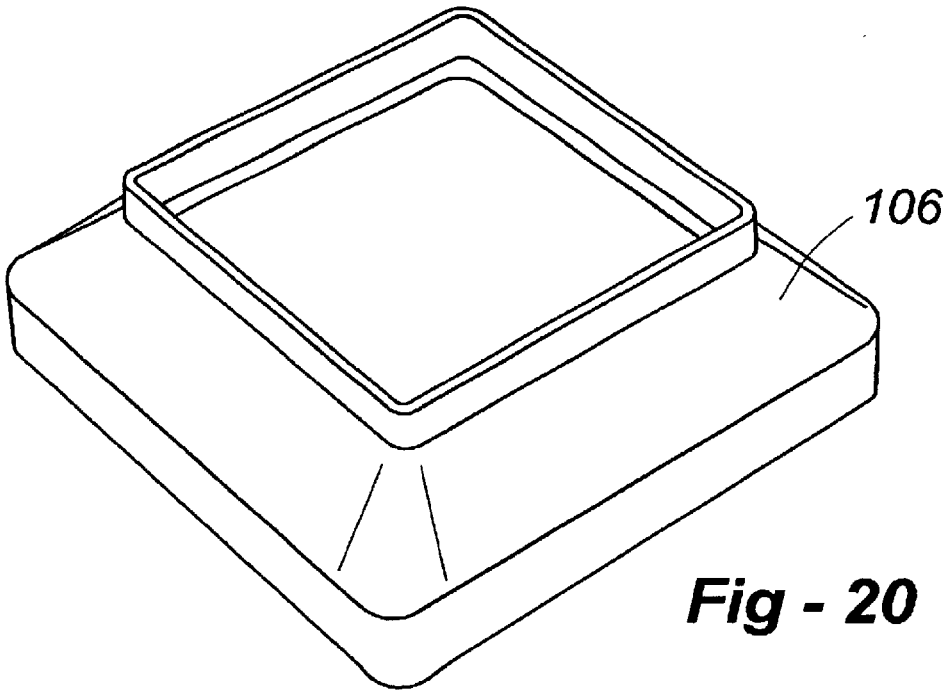
FIG. 20 is a perspective view of a fence post base for use with the present invention.
Figure 21:
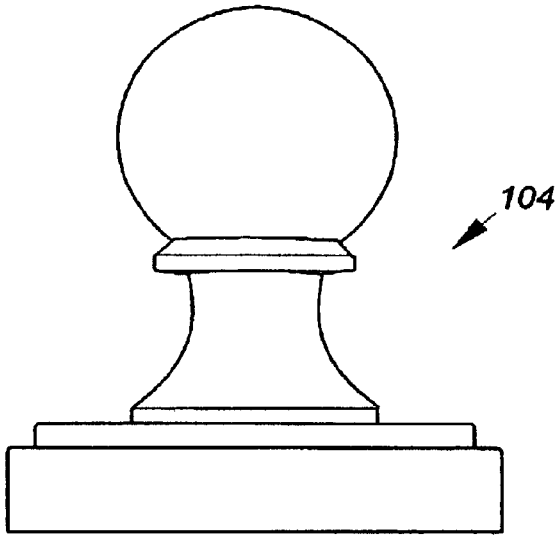
FIG. 21 is a front elevational view of the fence post cap of FIG. 19.
Figure 22:
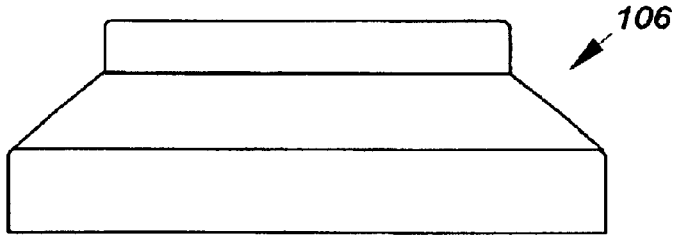
FIG. 22 is a front elevational view of the base of FIG. 20.
Figure 23:
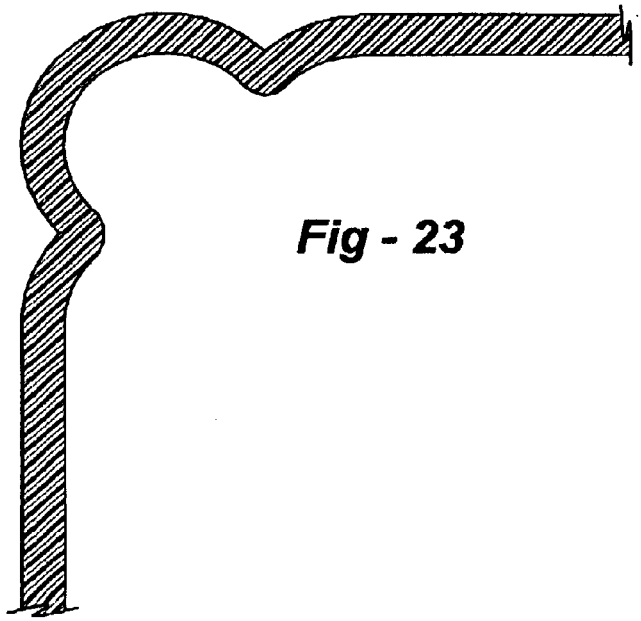
FIG. 23 is a cross-sectional view of a corner of the fence post cover of FIG. 18, showing one embodiment of the corner detail.

Referring now to FIG. 18, a fence post cover assembly is generally shown at 100. The assembly 100 includes a post cover 102, a cap 104, and a base 106. In assembling a fence using the components of the present invention, a 4×4 wood post is preferably set in the ground and then covered using the post cover 102. The base 106 is positioned around the base of the post and a cap 104 closes off the top. The cap 104 is shown in more detail in FIGS. 19 and 21, and the base is shown in more detail in FIGS. 20 and 22. FIG. 23 illustrates a detailed cross-section of a corner of the post cover 102. The cover assembly 100 shown in FIG. 18 is the preferred covering for the larger version of posts shown at 12 and 18 in FIG. 1. The smaller version of post 14 is preferably plastic without a wood core. Consequently, it preferably has a thick wall to increase its stiffness. However, it is preferred that it is merely a smaller version of the assembly 100 in FIG. 18. That is, it has the same shape and design, but the post cover 102 becomes the post itself, and has a smaller front-to-back and side-to-side dimension. It also preferably has a thicker wall section.

Figure 24:
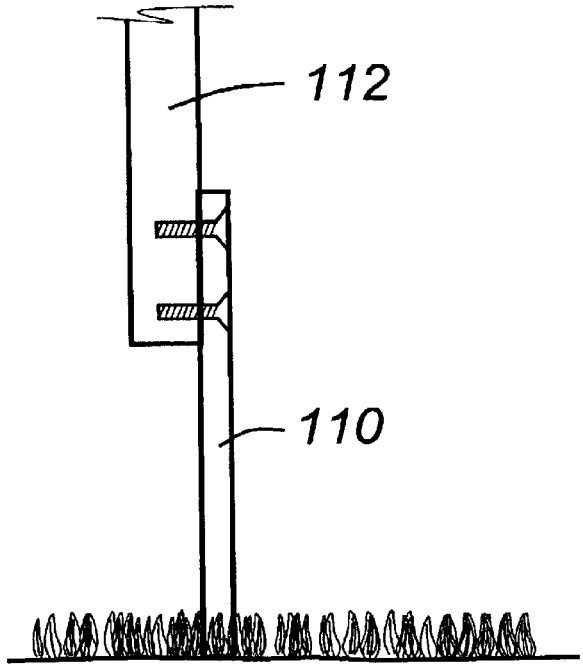
FIG. 24 is a view of a portion of a vertical member of a fence panel, along with a support member attached thereto.

Referring now to FIG. 24, an accessory for the fence panels according to the present invention is illustrated. Specifically, a support member 110 is illustrated fastened to the bottom of a vertical member 112. The support member is a small piece of plastic that may be screwed or otherwise fastened to the bottom of one of the vertical members 112, and extends downwardly so as to contact the ground. As is known to those of skill in the art, injection molded plastic products will sometimes sag in use. Because of the preferred size of the panels 10, it is preferred that a support member 110 be attached to one of the vertical members in the middle of a span and extend downwardly so as to contact the ground. This small amount of support is sufficient to minimize or avoid sag of the panels.

As will be clear to those of skill in the art, the plastic fence disclosed herein may be molded or formed in various ways. The fence panels may be molded such that the horizontal rails and vertical members are each solid plastic, as illustrated. One preferred material is glass fiber filled polypropylene. Alternatively, the plastic fencing may be low-pressure injection molded with gas assist. This process may lead to hollowing out of some of the horizontal rails or vertical members, due to the gas assist. This, in turn, reduces the amount of plastic required to form the plastic fencing.

According to a further aspect of the present invention, the molded plastic fence panels achieve the look of wrought iron. According to a preferred embodiment of the present invention, this is achieved by using a 30 percent glass filled polypropylene with a carbon black coloring. This combination achieves the somewhat dulled black surface of wrought iron. Reducing or eliminating the glass fiber in the polypropylene would lead to a shiny surface that would not effectively simulate wrought iron. As will be clear to those of skill in the art, this combination of materials may be used in other applications. For this purpose, the present invention recognizes the preferability of using short glass fibers to provide a 30 percent glass filled polypropylene with carbon black. Glass fiber concentrations above 25 percent are also preferred, though 30 percent or more is most preferred.

As will be clear to those of skill in the art, the present specification and figures illustrate only preferred embodiments of the present invention, and the various shapes, sizes and configurations may be altered without departing from the scope or teaching of the present invention. It is the following claims, including all equivalents, which define the scope of the present invention.

I claim:

1. An injection molded plastic fence panel having a top, a bottom, and a pair of sides, the panel further having a front face and a back face, the panel comprising:

an upper horizontal rail extending continuously between the pair of sides, the upper rail having a generally constant cross section along the continuous length, the rail having a transversely concave front surface and a transversely concave rear surface with an upper and lower edge interconnecting the front and rear surfaces, the front and rear surfaces each having central regions intermediate the edges, the central regions being separated by a distance less than the front to back depth of the edges, the transversely concave surfaces being visible along the entire length of the rail;

a lower horizontal rail extending continuously between the pair of sides, the lower rail having a generally constant cross section along the continuous length, the rail having a transversely concave front surface and a transversely concave rear surface with an upper and lower edge interconnecting the front and rear surfaces, the front and rear surfaces each having central regions intermediate the edges, the central regions being separated by a distance less than the front to back depth of the edges, the transversely concave surfaces being visible along the entire length of the rail; and a plurality of spaced apart vertical members extending between and interconnecting the upper and lower horizontal rails.

2. The panel according to claim 1, wherein the horizontal rails have an I-beam shaped cross section.

3. The panel according to claim 1, wherein the horizontal rails have a bowtie shaped cross section.

4. The panel according to claim 1, wherein the front and rear surfaces of the horizontal rails are non-symmetrical.

5. The panel according to claim 1, wherein the horizontal rails are solid.

6. The panel according to claim 1, further comprising an intermediate horizontal rail spaced below the upper rail and above the lower rail, the intermediate rail having a concave front surface and a concave rear surface with a pair of edges interconnecting the front and rear surfaces, the front and rear surfaces each having central regions intermediate the edges, the central regions being separated by a distance less than the front to back depth of the edges.

7. The panel according to claim 1, wherein each of the vertical members is parallel the other vertical members.

8. The panel according to claim 1, wherein the upper and lower horizontal rails are parallel.

9. The panel according to claim 1, wherein the vertical members further extend above the upper rail and below the lower rail.

10. The panel according to claim 9, wherein the vertical members each have an upper end with a decorative top molded thereon.

11. The panel according to claim 1, wherein the vertical members and the horizontal rails are coplanar.

* * * * *